United States Patent [19]

Fish et al.

[11] 4,290,279

[45] Sep. 22, 1981

[54] PADLOCK WITH INTERCHANGEABLE CYLINDER

[75] Inventors: Aaron M. Fish, Hampstead; Jean-Paul Dausseing, Montreal, both of Canada

[73] Assignee: Unican Security Systems, Ltd., Montreal, Canada

[21] Appl. No.: 168,117

[22] Filed: Jul. 14, 1980

[51] Int. Cl.[3] ..... E05B 67/22

[52] U.S. Cl. ..... 70/38 A; 70/52; 70/367

[58] Field of Search ..... 70/25, 38 R, 38 A, 38 B, 70/38 C, 51, 52, 53, 367

[56] References Cited

U.S. PATENT DOCUMENTS

| | | | |
|---|---|---|---|
| 1,636,381 | 7/1927 | Megie | 70/38 B |
| 3,422,643 | 1/1969 | Foote | 70/38 B |
| 4,112,715 | 9/1978 | Uyeda | 70/38 A |

*Primary Examiner*—Robert L. Wolfe

*Attorney, Agent, or Firm*—Ira Milton Jones

[57] ABSTRACT

A padlock comprising a body having a pair of parallel bores therein adapted to receive the legs of a shackle, and a shackle having a pair of parallel legs slidably received in said bores. A locking means is positioned within the padlock body to secure the shackle in the body when the legs are depressed into the bores. An interchangeable means, such as a standard cylinder lock, is provided for releasing the locking means and includes key-operated means operable by turning movement of a key to effect the release of the shackle from the locking means to allow one of the shackle legs to withdraw from the padlock body. The padlock body has an opening to receive the interchangeable means to permit positioning the interchangeable means within the padlock body. Detachable cover means adapted to close the opening is provided. Fastener means, such as a screw member, operable from within the body, is engageable in fastening relation with the cover means. Tool means, such as a screwdriver tip, is carried by the other of said shackle legs within the padlock body. The tool means is movable by movement of the shackle to engage and move the fastener means whereby to selectively engage or disengage the fastener means relative to the cover means for selective connection or disconnection of the cover means relative to the padlock body.

10 Claims, 5 Drawing Figures

PADLOCK WITH INTERCHANGEABLE CYLINDER

BACKGROUND OF THE INVENTION

1. Field of the Invention

This invention relates to a padlock having a shackle for interengagement with a device to be locked and in which the shackle is movable between locked and unlocked positions under the control of a key, and more particularly to a padlock of this type having a replaceable cylinder lock or key cylinder.

2. Description of the Prior Art

In key-operated shackle-type padlocks of the prior art, various arrangements have been provided to permit removing and interchanging the cylinder lock (sometimes referred to as the "key cylinder") in order to permit substituting cylinder locks having different tumbler pin combinations. The following United States patents show arrangements for interchanging cylinder locks or key cylinders in a shackle-type padlock:

U.S. Pat. No. 2,691,288
Gary D. Childs
Issued: Oct. 12, 1954

U.S. Pat. No. 3,835,675
Guillermo W. Lippisch
Issued: Sept. 17, 1974.

In providing a padlock construction which permits easy interchangeability of cylinder locks, it is important that the easy interchangeability be provided without sacrificing the lock's security, since the padlock should be so constructed as to be substantially tamperproof and substantially invulnerable to intruders.

SUMMARY OF THE INVENTION

Accordingly, it is an object of the present invention to provide a shackle-type padlock of the key-operated type which is so constructed as to facilitate easy interchangeability of the cylinder lock or key cylinder of the padlock.

It is a further object of the invention to provide a shackle-type padlock having an improved arrangement for permitting interchangeability of the cylinder lock or key cylinder while also maintaining maximum security of the padlock.

It is a further object of the invention to provide a new and unique security padlock of the shackle-type which embodies in the padlock construction a built-in tool for facilitating removal or replacement of the cylinder lock or key cylinder of the padlock.

It is an object of a further feature of the invention to provide a shackle-type padlock having an improved arrangement for retaining the shackle in engaged relation with the body of the padlock when the padlock is unlocked, to thereby prevent the shackle from falling out of the padlock.

In achievement of these objectives, there is provided in accordance with the invention, a padlock comprising a body having a pair of parallel bores therein adapted to receive the legs of a shackle, the shackle having a pair of parallel legs slidably received in said bores, locking means positioned within the body to secure the shackle therein when the legs are depressed into the bores, an interchangeable means for releasing the locking means comprising key-operated means operable by turning movement of a key to effect the release of the shackle from the locking means to allow one of the legs to withdraw from the body, the body having an opening to receive the interchangeable means to permit positioning the interchangeable means within the body, detachable cover means adapted to close the opening, fastener means operable from within the body and engageable in fastening relation with the cover means, tool means carried by the other of the shackle legs within said body, the tool means being movable by movement of the shackle to engage and move the fastener means whereby to selectively engage or disengage the fastener means relative to the cover means for selective connection or disconnection of the cover means relative to the padlock body.

A further feature of the invention comprises the provision of a retainer means which is carried by the other of said shackle legs and which rides in an additional bore parallel to and communicating with the bore in which said other leg is slidably movable. The additional bore includes abutment means in the path of travel of the retainer means to limit the travel of said other shackle leg in its corresponding bore, and thus prevent the shackle from falling out of the padlock body.

BRIEF DESCRIPTION OF THE DRAWINGS

With these observations and objectives in mind, the manner in which the invention achieves its purpose will be appreciated from the following description and the accompanying drawings, which exemplify the invention, it being understood that changes may be made in the specific apparatus disclosed herein without departing from the essentials of the invention set forth in the appended claims.

The accompanying drawings illustrate one complete example of the embodiment of the invention constructed according to the best mode so far devised for the practical application of the principles thereof, and in which.

DESCRIPTION OF THE PREFERRED EMBODIMENT

Figure 2:
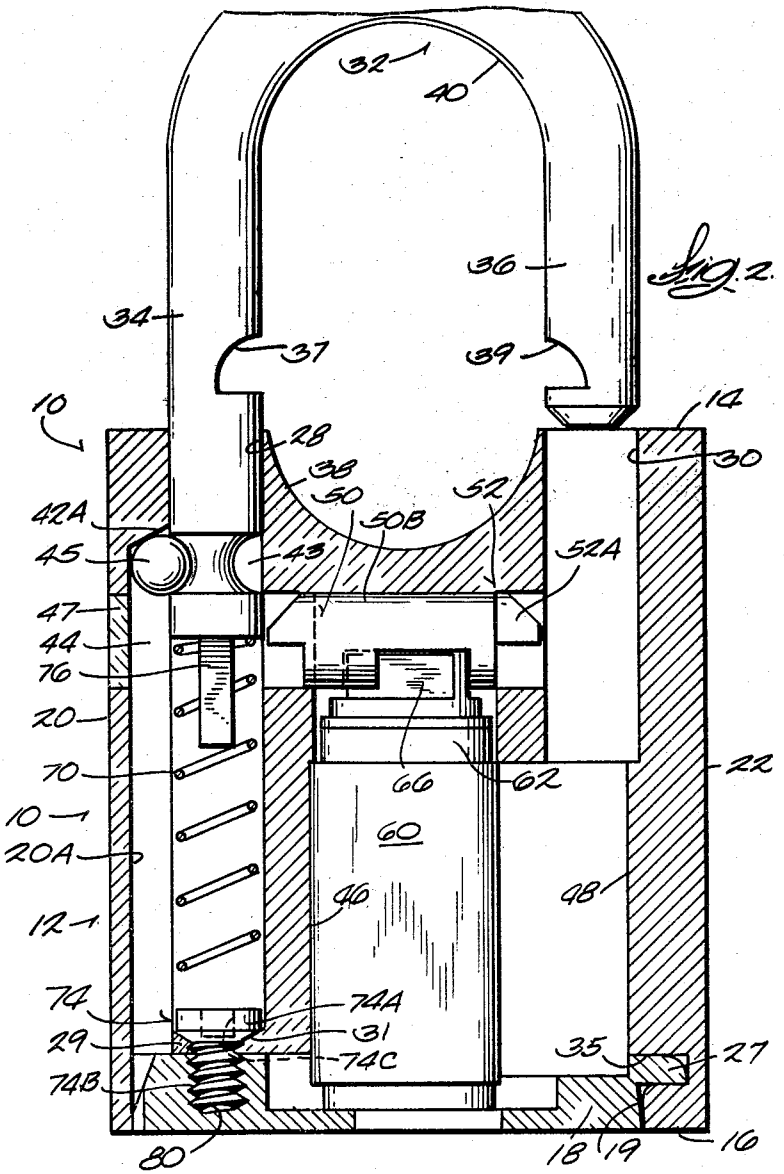
FIG. 2 is a view partially in elevation and partially in section of the padlock of FIG. 1 in unlocked condition.

Referring now to the drawings, there is shown a security padlock, generally indicated at 10, including a padlock body 12, which may be fabricated or machined from a block of suitable solid material, such as brass, for example. The padlock body 12 is substantially rectangular in cross section and includes a top face 14 and a bottom face 16 which is open for a large part of the area thereof, as indicated at 19, to receive a cylinder cover plate 18 to be described hereinafter. Padlock body 12 also includes opposite left and right side faces 20 and 22 and front and rear faces 24 and 26. The terms "top", "bottom", "left", "right", "front", and "rear" are used as a matter of convenience to identify the various faces of lock body 12 relative to the views shown in the drawings. The top face 14 of padlock body 12 is pierced by a pair of parallel bores 28 and 30 which receive a shackle, generally indicated at 32. Bore 28 extends for most of but not all of the distance from upper face 14 to bottom opening 19 which receives cylinder cover plate 18. Bore 28 terminates at its lower end in a bottom wall portion 29 having a countersunk opening 31 therein to receive a screw 74 which secures cylinder cover plate 18 in position, as will be described in more detail hereinafter.

Bore 30 is relatively shorter than bore 28 and extends substantially only approximately half the distance between upper and lower faces 14 and 16 of the padlock body 12.

The shackle 32 is of "J" shape, including a longer leg 34 which is received in the longer bore 28 in padlock body 12 and a shorter leg 36 which is received in the shorter bore 30 of padlock body 12. Upper face 14 of the padlock body includes a centrally located depression defined by semi-circular arcuate surface 38 and having substantially the same radius of curvature as the inner radius 40 of the arcuate connecting portion of shackle 32 which joins the two shackle legs 34 and 36, whereby the arcuate inner surface 40 of shackle 32 and the arcuate surface 38 in upper face 14 of padlock body 12 together define a circular opening when padlock 10 is in the locked condition shown in FIG. 1.

Padlock body 12 is also provided on the left-hand side thereof, relative to the views in the drawings, with a bore 42 contiguous and parallel to shackle bore 28. Bore 42 extends with its upper end at a location proximate to but spaced below upper face 14 of padlock body 12 and with its lower end in communication with opening 19 in bottom face 16 of the padlock body, relative to the views in the drawings. Bore 42 communicates for its entire length with bore 28. The purpose of bore 42 is to define a travel passage for a retainer ball 45 carried by circumferential groove 43 of shackle leg 34, as will be explained in more detail hereinafter.

Padlock body 12 is also provided with a cross bore 44 which extends inwardly from side face 20 of padlock body 12, the cross bore 44 extending into communication with shackle bores 28 and 30.

Figure 1:
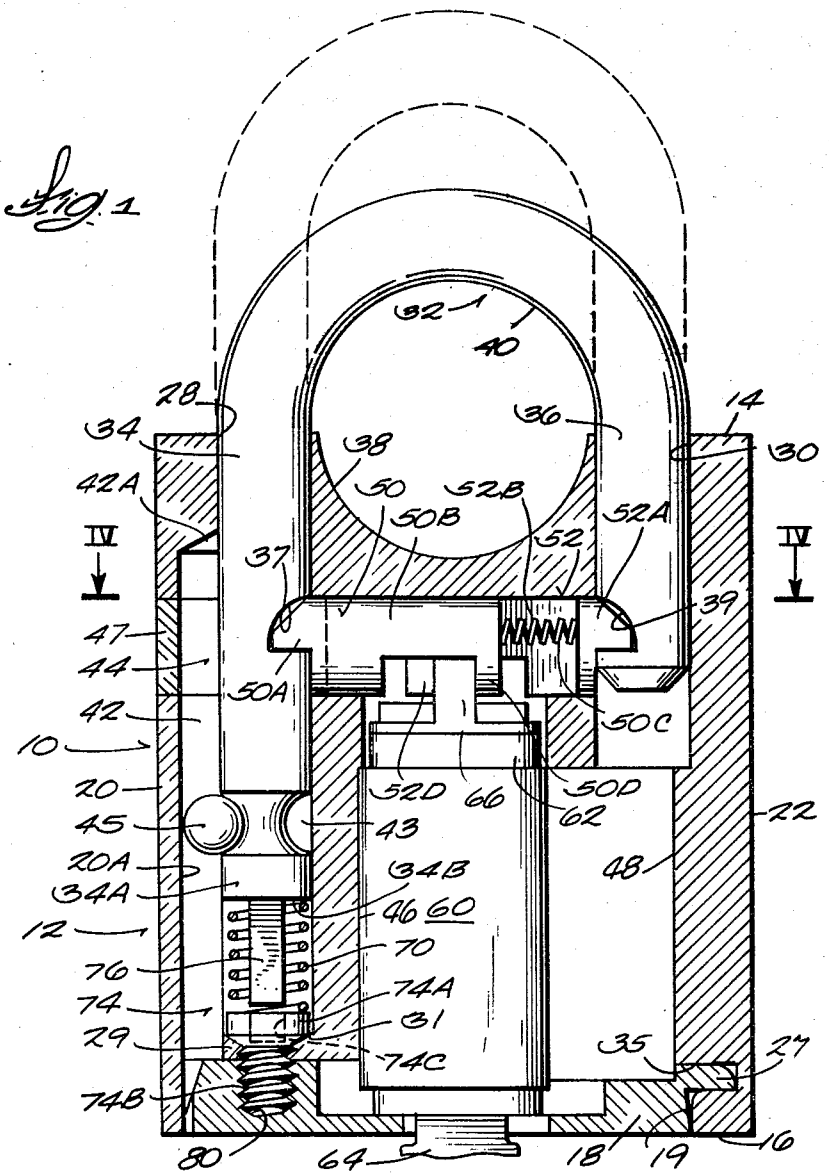
FIG. 1 is a view partially in elevation and partially in section of a padlock in accordance with the invention, showing the padlock in closed or locked position.

Cross bore 44 slidably receives a pair of pawls, generally indicated at 50 and 52, which serve to retain shackle 32 in its locked position as seen in the view of FIG. 1. Cross bore 44 is closed by means of a plug 47 in the left face 20 of the padlock body after pawls 50 and 52 have been positioned in the cross bore 44.

Padlock body 12 is also provided with a pair of parallel communicating bores 46 and 48 which receive cylinder lock 60. Bores 46 and 48 communicate at their lower ends with opening 19 in the bottom face of padlock body 12 to permit insertion of cylinder lock 60 into, or to permit removal of cylinder lock 60 from, bores 46 and 48 when cylinder cover plate 18 is removed. Bore 46 communicates at its upper end with cross bore 44 while bore 48 communicates at its upper end with shackle bore 30.

Legs 34 and 36 of shackle 32 are respectively provided with facing notches or recesses 37 and 39 which are adapted to receive pawl dogs 50A and 52A of the respective pawls 50 and 52. Each of the pawls 50 and 52 is provided with an extended projection, respectively indicated at 50B and 52B, which is bored to receive a corresponding coil spring 50C, 52C which bears against the oppositely disposed pawl 50 or 52, whereby the two pawls 50 and 52 are urged by the springs 50C and 52C in a laterally outward direction into engagement with notches 37 and 39 in the respective shackle legs 34 and 36 when shackle 32 is in the depressed or locked position of FIG. 1.

Each of the pawls 50 and 52 is also provided at its outer end with a downwardly depending lug, respectively indicated at 50D and 52D.

In order to actuate the pawls 50, 52 a cylinder lock, generally indicated at 60, is received within the communicating bores 46, 48 in padlock body 12. Cylinder lock 60 may be of a standard type, well-known in the art, and having a cylindrical key plug 62 adapted to be turned by a key 64. A cam 66 is detachably mounted on and is rotatable with cylindrical plug 62 when key 64 is rotated. Cam 66 is interposed between the two downwardly depending lugs 50D, 52D of the respective pawls 50, 52 whereby rotation of cylindrical plug 62, due to rotation of key 64, causes rotation of cam 66 from the position shown in FIG. 1 to the position shown in FIG. 3 whereby to retract dogs 50A, 52A of the respective pawls against the biasing force of springs 50C, 50D out of locking engagement with notches 37, 39 of the oppositely disposed shackle legs 34, 36.

The upper or outer end of bore 42 in which retainer ball 45 rides terminates in a tapered surface 42A which serves as a limiting abutment for retainer ball 45 when shackle 32 is in the open position shown in FIG. 2. The engagement of retainer ball 45 with tapered shoulder 42A prevents any further outward opening movement of shackle 32 beyond that shown in FIG. 2 and confines shackle leg 34 in bore 28 to prevent shackle 32 from becoming detached from padlock 10.

The lower end of shackle 34 beneath circumferential groove 41 is provided with a short leg portion 34A having an undersurface 34B which defines a shoulder or spring seat for a coil spring 70. A screwdriver tip 76 extends downwardly from the undersurface 34B of leg portion 34A and is positioned within coil spring 70. Screwdriver tip 76 in the illustrated embodiment is of the Robertson type and includes a tip portion of square cross section adapted to engage a correspondingly-shaped socket 74C in the head 74A of screw 74 when cover plate 18 is to be mounted on or removed from padlock body 12. Screw 74 also includes a threaded shank portion 74B.

Figure 5:
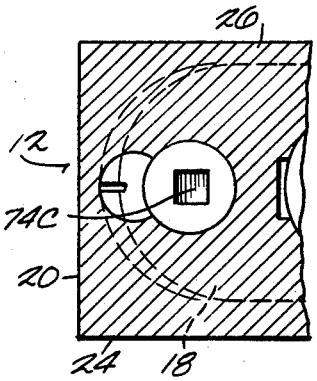
FIG. 5 is a view in section taken along line V—V of FIG. 3.
Figure 4:
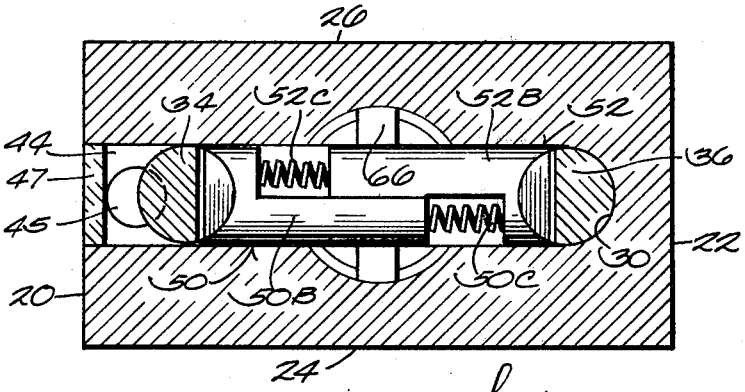
FIG. 4 is a view taken in section on line IV—IV of FIG. 1.

The lower end of bore 28 which receives shackle leg 34 terminates in a countersunk opening 29 through which threaded shank portion 74B of screw 74 can pass to threadedly engage threaded passage 80 in cylinder cover plate 18. Socket 74C in screw head 74A is of square cross section, as best seen in FIG. 5. Socket 74C receives the lower square cross section end of screwdriver tip 76 when shackle 32 is in the position shown in FIG. 3, whereby rotation of shackle leg 34 with screwdriver tip 76 engaged with socket 74C of screw 74, causes rotation of screw 74 relative to the mating screw-threaded passage 80 in cylinder cover plate 18 to either secure cover plate 18 to padlock body 12 or to remove cover plate 18 from padlock body 12, depending upon the direction of rotation of screw 74.

Coil spring 70 is received in bore 28 beneath shoulder 34B of shackle leg portion 34A. The upper end of spring 70 (relative to the views in the drawings) seats on shoulder 34B, and the lower end of spring 70 seats on head 74A of screw 74. Spring 70 surrounds screwdriver tip 76. When shackle 32 is in the closed position shown in FIG. 1, spring 70 is compressed, and when the padlock is in the unlocked position of FIG. 2, spring 70 is expanded and moves the shackle 32 outwardly to the limiting position defined by the engagement of retaining ball 45 with shoulder 42A at the outer end of bore 42.

In using the padlock, assume that the padlock is open and that key 64 has been turned to cause cam 66 to be in the position shown in FIG. 1. To close the padlock, shackle 32 is pushed inwardly from the dotted line position of FIG. 1. During the inward movement of shackle 32, when notches 37 and 39 in shackle legs 34 and 36 become aligned with pawls 50 and 52, pawl dogs 50A and 52A, under the influence of their respective springs 50C and 52C, will snap into engagement with the notches 37 and 39 in shackle legs 34 and 36, causing the padlock 10 to be in locked condition.

In the locked position of the padlock shown in FIG. 1, spring 70 is compressed between shoulder 34B of shackle leg portion 34A and the upper surface of screw 74 which, as shown in FIG. 1, is in screw-threaded engagement with threaded passage 80 of cylinder cover plate 18. In the locked position of the padlock as shown in FIG. 1, screwdriver tip 76 is in spaced relation to and does not engage socket 74C in the head of screw 74.

Assume now that it is desired to replace cylinder lock 60. To do this, key 64 is inserted through the key opening of cylinder cover plate 18 into engagement with cylinder lock 60 and into engagement with cylindrical plug 62 carried by cylinder lock 60, whereby rotation of key 64 turns plug 62 to rotate cam 66 to the position shown in FIGS. 2 and 3 of the drawings, in which cam 66 cammingly engages lugs 50D, 52D of the respective pawls 50, 52 to cause pawl dogs 50A, 52A to withdraw from notches 37, 39 in the respective shackle legs 34, 36. With pawl dogs 50A, 52A withdrawn from the notches in the shackle legs, spring 70 expands and causes outward movement of the shackle to the position shown in FIG. 2.

Figure 3:
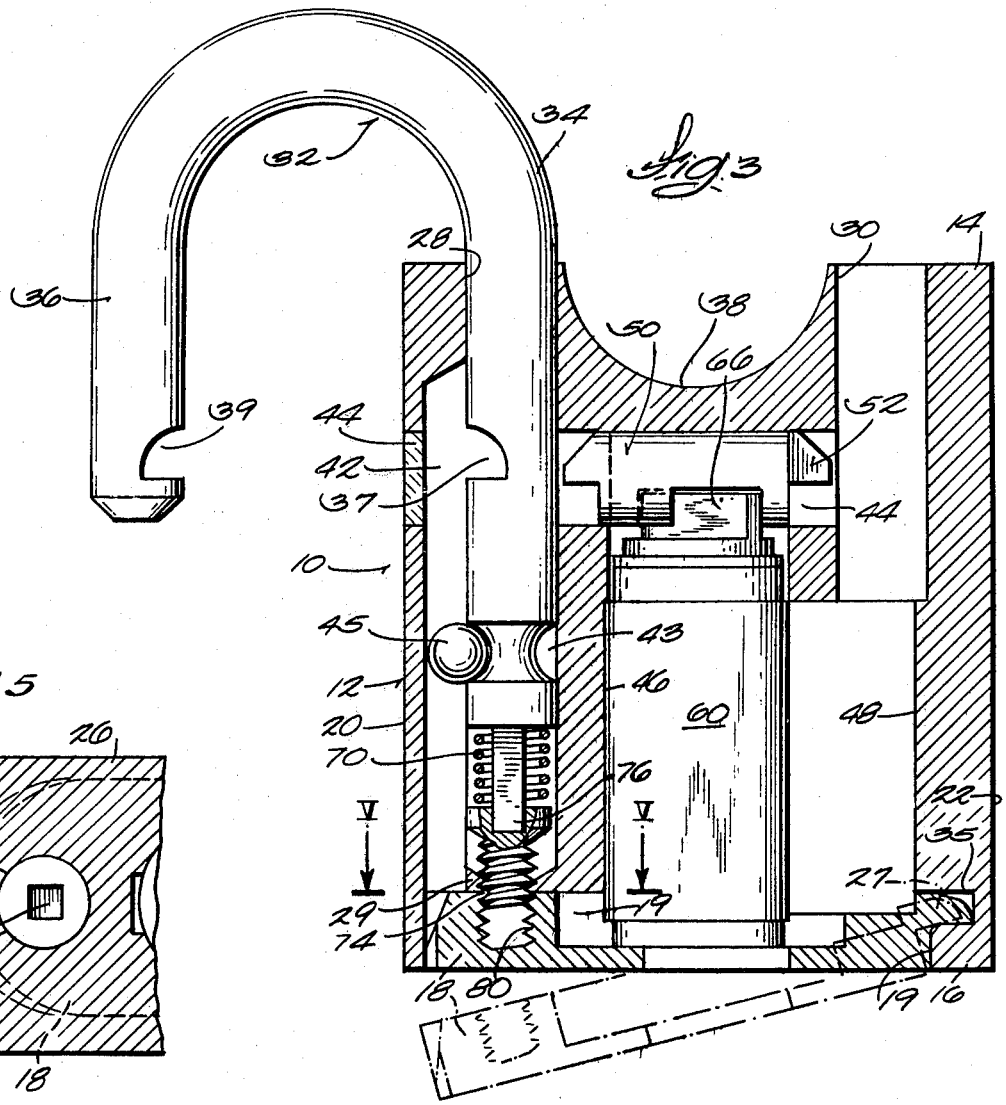
FIG. 3 is a view partially in elevation and partially in section of the padlock in unlocked condition and with the shackle moved to a position in which the tool carried by one leg of the shackle is shown in engagement with the screw member which secures the cylinder cover plate in position.

With the shackle in the position of FIG. 2, shackle 32 is rotated by the operator to the outboard position shown in FIG. 3, and the shackle is also compressed by the operator inwardly into bore 28 to cause screwdriver tip 76 to engage socket 74C in the head of screw 74. Shackle 32 is then rotated by the operator to unscrew screw 74 from engagement with screw-threaded passage 80 in cylinder cover plate 18. When the screw 74 has been completely withdrawn from threaded passage 80 in cylinder cover plate 18, cover plate 18 then drops to the phantom position shown in FIG. 3, in which one end of plate 18 is still retained by the engagement of catching tip 27 of plate 18 with recess 35 in padlock body 12.

The operator then locks the padlock by key 64, removes key 64, and then removes cylinder cover plate 18 by detaching catching tip 27 of plate 18 from its engagement with recess 35 in padlock body 12. Cylinder lock 60 is then withdrawn from bores 46, 48. Before installing the new cylinder lock, the detachably mounted cam 66 is removed from the cylinder lock 60 which has just been removed, and is suitably detachably mounted on the new cylinder lock 60 which is to be substituted.

The operator then inserts key 64 into the new cylinder lock 60, places the cylinder lock into bores 46, 48 of padlock body 12, and turns key 64 slightly to facilitate the engagement of cam 66 with respect to pawls 50 and 52. The operator then opens the padlock and carefully removes key 64 from cylinder lock 60.

With the new cylinder lock 60 in position in bores 46, 48 of padlock body 12, catching tip 27 of cover plate 18 is again engaged with recess 35 in padlock body 12, and cylinder cover plate 18 is then pushed into closing relation to opening 19 at the bottom of padlock body 12. Shackle 32 is then moved to the position shown in FIG. 3 to engage screwdriver tip 76 with socket 74C in screw 74, as previously described. Shackle 32 is then turned to cause screw 74 to threadedly engage the mating screw-threaded passage 80 in cylinder cover plate 18, to secure cover plate 18 to padlock body 12.

Those skilled in the art will appreciate that the invention can be embodied in forms other than as herein disclosed for purposes of illustration.

We claim:

1. A padlock comprising:
- a body having a pair of parallel bores therein adapted to receive the legs of a shackle;
- a shackle having a pair of parallel legs slidably received in said bores;
- locking means positioned within said body to secure said shackle in said body when said legs are depressed into said bores;
- interchangeable means for releasing said locking means, comprising
  - key-operated means operable by turning movement of a key to effect the release of said shackle from said locking means to allow one of said legs to withdraw from said body, said body having an opening to receive said interchangeable means to permit positioning said interchangeable means within said body;
- detachable cover means adapted to close said opening;
- fastener means operable from within said body and engageable in fastening relation with said cover means;
- tool means carried by the other of said shackle legs within said body,
  - said tool means being movable by movement of said shackle to engage and move said fastener means, whereby to selectively engage or disengage said fastener means relative to said cover means for selective connection or disconnection of said cover means relative to said padlock body.

2. A padlock as defined in claim 1, in which said interchangeable means comprises
- a cylinder lock, said cylinder lock including a key plug operable by turning movement of a key to release said shackle from said locking means.

3. A padlock as defined in claim 1, in which said tool is a screwdriver means, and in which
- said fastener means is a screw adapted to be engaged and turned by said screwdriver means,
  - said cover means including a cooperating screw-threaded passage adapted to receive said screw, whereby to detachably secure said cover means to said body.

4. A padlock as defined in claim 1, in which said cover means includes:
- a projecting portion adapted to interengage with a corresponding recess in said padlock body and in spaced relation to the location where said fastening means engages said cover means, whereby to assist in securing said cover means to said padlock body.

5. A padlock as defined in claim 1, in which said locking means includes
- a first and second pawl normally spring biased into locking engagement with the respective shackle legs when said legs are depressed into said parallel bores, and cam means mounted within said body contiguous said first and said second pawl and operable by said key-operated means to cam said pawls out of said locking engagement with said shackle legs.

6. A padlock as defined in claim 1, in which the other of said shackle legs is slidably movable in but confined to its corresponding bore during normal usage of said padlock, retainer means carried by said other leg intermediate the length of said other leg, said body including an additional bore extending parallel to and communicating with said corresponding bore, said retainer means being slidably movable in said additional bore during sliding movement of said other leg in said corresponding bore, said additional bore including abutment means in the path of said retainer means for limiting the sliding movement of said other leg in said corresponding bore, whereby to confine said other leg in said corresponding bore to prevent said shackle from falling out of said padlock body.

7. A padlock as defined in claim 6, in which said retainer means is a ball, and said other leg includes a circumferential groove for retaining said ball.

8. A padlock as defined in claim 1, in which the other of said legs of said shackle moves in a corresponding one of said parallel bores, and a spring is positioned within said corresponding bore in interposed relation between the inner end of said other leg and the facing end of said corresponding bore, whereby to bias said other leg in an outward direction in said corresponding bore.

9. A padlock comprising:

a body having a pair of parallel bores therein adapted to receive the legs of a shackle;

a shackle having a pair of parallel legs slidably received in said bores;

a first and second pawl positioned within said body and normally spring biased into locking engagement with the respective shackle legs when said legs are depressed into said parallel bores;

a cylinder lock positioned within said body, said cylinder lock including a key plug operable by turning movement of a key to release said pawls from locking engagement with said shackle legs to allow one of said legs to withdraw from said body, said body having an opening to receive said cylinder lock to permit positioning said cylinder lock within said body;

detachable cover means adapted to close said opening;

screw means operable from within said body and engageable in screw-threaded relation with a cooperating threaded passage in said cover means;

a screwdriver means carried by the other of said shackle legs within the corresponding bore in which said other shackle leg is slidably movable, said screwdriver means being movable by movement of said shackle to engage and turn said screw relative to said cooperating threaded passage in said cover means, whereby to secure said cover means to said body or to release said cover means from said body, depending upon the direction of rotation of said screw.

10. A padlock as defined in claim 9, in which the bottom of said corresponding bore has a passage therein for receiving said screw, and said cooperating threaded passage in said detachable cover is in alignment with said passage in said bottom of said corresponding bore when said detachable cover is positioned in said opening.

* * * * *